US011131005B2

(12) United States Patent
Staudte et al.

(10) Patent No.: US 11,131,005 B2
(45) Date of Patent: Sep. 28, 2021

(54) METHOD FOR PRODUCING A METALLIC COATED STEEL SHEET

(71) Applicant: ArcelorMittal, Luxembourg (LU)

(72) Inventors: Jonas Staudte, Montigny-lès-Metz (FR); Hubert Saint-Raymond, Metz (FR); Michel Roger Louis Bordignon, Sprimont (BE); Thierry Hourman, Teteghan (FR); Pauline Briault, Metz (FR)

(73) Assignee: ArcelorMittal, Luxembourg (LU)

( * ) Notice: Subject to any disclaimer, the term of this patent is extended or adjusted under 35 U.S.C. 154(b) by 287 days.

(21) Appl. No.: 16/094,849

(22) PCT Filed: Apr. 18, 2017

(86) PCT No.: PCT/IB2017/000424
§ 371 (c)(1),
(2) Date: Oct. 18, 2018

(87) PCT Pub. No.: WO2017/182863
PCT Pub. Date: Oct. 26, 2017

(65) Prior Publication Data

US 2019/0119776 A1 Apr. 25, 2019

(30) Foreign Application Priority Data

Apr. 19, 2016 (WO) ..... PCT/IB2016/000486

(51) Int. Cl.
*C21D 9/56* (2006.01)
*C23C 2/02* (2006.01)
(Continued)

(52) U.S. Cl.
CPC ..... *C21D 9/561* (2013.01); *C21D 1/76* (2013.01); *C21D 9/46* (2013.01); *C21D 9/573* (2013.01);
(Continued)

(58) Field of Classification Search
CPC ..... C21D 9/46; C21D 9/561; C21D 9/573; C21D 1/76; C23C 2/02; C23C 2/04;
(Continued)

(56) References Cited

U.S. PATENT DOCUMENTS 5,783,622 A 7/1998 Sabata et al.
8,409,667 B2 4/2013 Bordignon et al.
(Continued)

FOREIGN PATENT DOCUMENTS

CN 101287854 10/2008
CN 101466860 6/2009
(Continued)

OTHER PUBLICATIONS

Search Report of PCT/IB2017/000424, dated Jul. 4, 2017.

*Primary Examiner* — Anthony J Zimmer
*Assistant Examiner* — Dean Mazzola
(74) *Attorney, Agent, or Firm* — Davidson, Davidson & Kappel, LLC

(57) ABSTRACT

A method for producing a metallic coated steel sheet is provided. The method includes continuously annealing a steel sheet in a continuous annealing furnace and hot dip coating the steel sheet.

27 Claims, 1 Drawing Sheet

(51) Int. Cl.

| | |
|---|---|
| ***C23C 2/40*** | (2006.01) |
| ***C21D 1/76*** | (2006.01) |
| ***C21D 9/46*** | (2006.01) |
| ***C21D 9/573*** | (2006.01) |
| ***C23C 2/06*** | (2006.01) |
| ***C23F 17/00*** | (2006.01) |
| ***C23C 2/26*** | (2006.01) |
| ***C22C 38/00*** | (2006.01) |
| *C22C 38/02* | (2006.01) |
| *C22C 38/04* | (2006.01) |
| *C22C 38/06* | (2006.01) |
| *C22C 38/22* | (2006.01) |
| *C22C 38/26* | (2006.01) |
| *C22C 38/28* | (2006.01) |
| *C22C 38/32* | (2006.01) |

(52) U.S. Cl.
CPC ..... *C23C 2/02* (2013.01); *C23C 2/06* (2013.01); *C23C 2/40* (2013.01); *C23F 17/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C23C 2/26* (2013.01)

(58) Field of Classification Search
CPC .... C23C 2/06; C23C 2/12; C23C 2/26; C23C 2/40; C23F 17/00; C22C 38/001; C22C 38/002; C22C 38/02; C22C 38/04; C22C 38/06; C22C 38/22; C22C 38/26; C22C 38/28; C22C 38/32
See application file for complete search history.

(56) References Cited

U.S. PATENT DOCUMENTS

| | | | | |
|---|---|---|---|---|
| 8,470,102 | B2 | 6/2013 | Bertrand et al. | |
| 9,206,498 | B2 | 2/2015 | Mataigne et al. | |
| 9,702,020 | B2 | 7/2017 | Takahashi et al. | |
| 9,957,582 | B2 | 5/2018 | Velasquez et al. | |
| 10,053,749 | B2 | 8/2018 | Park et al. | |
| 10,590,509 | B2 | 3/2020 | Takahashi et al. | |
| 2009/0123651 | A1 | 5/2009 | Okada | |
| 2011/0252849 | A1 * | 10/2011 | Park | C23C 2/28 72/38 |
| 2015/0361520 | A1 * | 12/2015 | Takahashi | C21D 9/5735 118/65 |

FOREIGN PATENT DOCUMENTS

| | | | | |
|---|---|---|---|---|
| CN | 102325907 | | 1/2012 | |
| CN | 102268516 | B * | 5/2013 | |
| CN | 103507324 | | 1/2014 | |
| CN | 103507324 | A | 1/2014 | |
| CN | 104053796 | | 9/2014 | |
| CN | 104379776 | | 2/2015 | |
| EP | 2806043 | A1 | 11/2014 | |
| EP | 2862946 | A1 | 4/2015 | |
| JP | 2000336466 | | 12/2000 | |
| JP | 2002003953 | | 1/2002 | |
| JP | 2002003953 | A | 1/2002 | |
| RU | 2203980 | C2 | 5/2003 | |
| RU | 2451094 | C2 | 5/2012 | |
| WO | WO-2014129177 | A1 * | 8/2014 | C23C 2/003 |

* cited by examiner

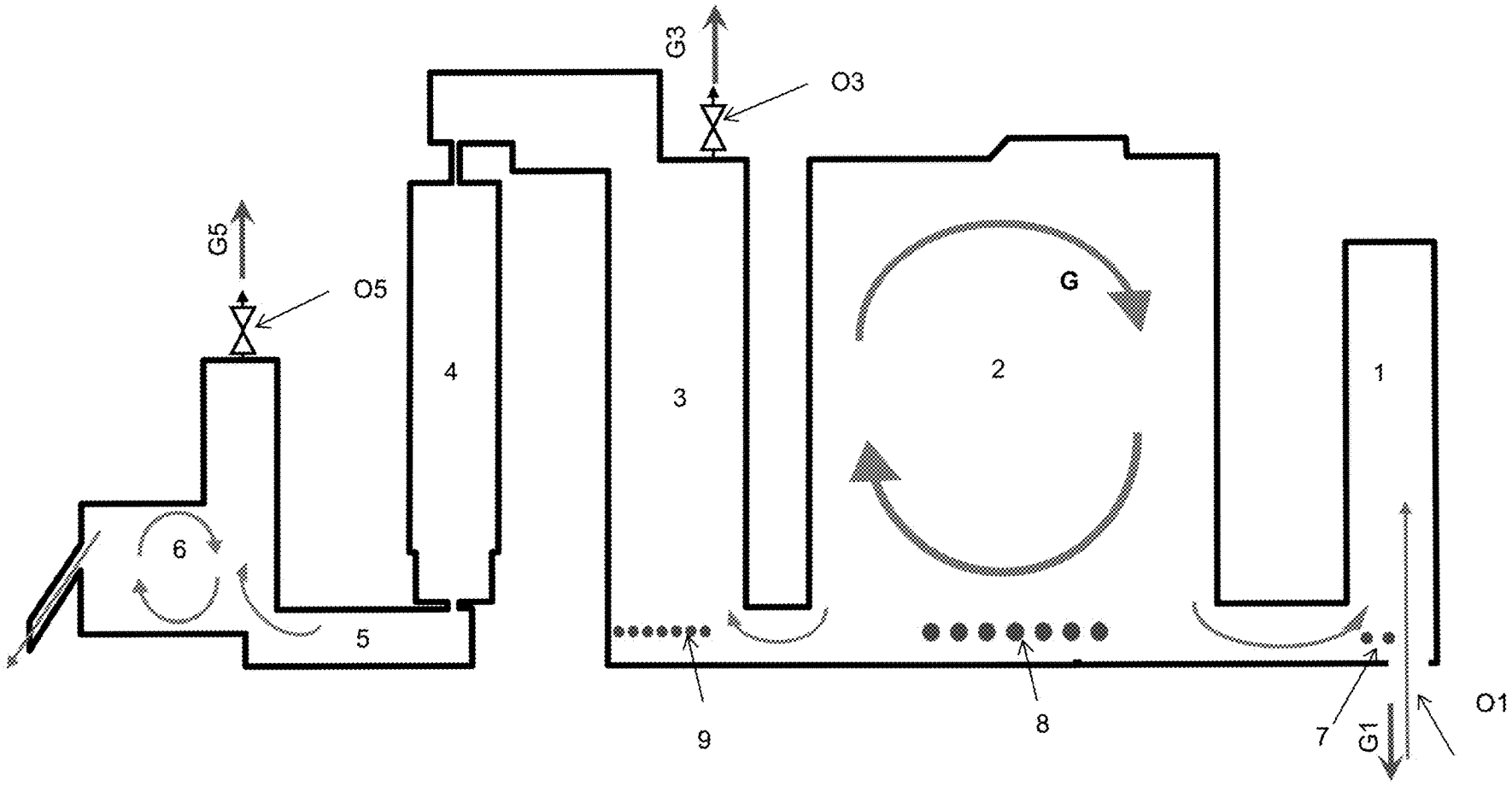
O1
G1
1
7
G
2
8
O3
G3
3
9
4
O5
G5
5
6

METHOD FOR PRODUCING A METALLIC COATED STEEL SHEET

The present invention relates to a method for producing a metallic coated steel sheet. The invention is particularly well suited for the manufacture of automotive vehicles.

BACKGROUND

It is well known to use coated steel sheets for the manufacture of among others automotive vehicles. Any kind of steel sheet can be used, for example IF (Interstitial-Free) steel, TRIP (Transformation-Induced Plasticity) steel, HSLA (High strength-low alloy steel) or DP (Dual Phase) steels. Such steel sheets are often coated with metallic coating such as zinc-based coatings or aluminum-based coatings. Indeed, these coatings allow a protection against corrosion thanks to barrier protection and/or cathodic protection. They are often deposited by hot-dip coating.

Before the deposition of such coatings, there is a step for the surface preparation of the steel sheet. Indeed, after cold- or hot-rolling, the steel sheet is wound to form coils. Coils can sometimes stay in storage warehouses for several weeks in contact of air. In this case, the iron of steel can react with air, in particular with the oxygen of air, in order to form iron oxides on the steel sheet surface. So, the surface preparation is usually performed by doing an annealing in a reducing atmosphere, i.e. comprising hydrogen gas ($H_2$), in order to reduce iron oxides into metallic iron on the steel surface as follows:

$$FeO+H_2 \rightarrow Fe^{(0)}+H_2O, \quad (1)$$

$$Fe_2O_3+3H_2 \rightarrow 2Fe^{(0)}+3H_2O \text{ and} \quad (2)$$

$$Fe_3O_4+4H_2 \rightarrow 4H_2O+3Fe^{(0)}. \quad (3)$$

Mainly $Fe_3O_4$ will be present at the surface, but $Fe_2O_3$ and FeO might also be observed.

However, especially for high strength steel or ultra-high strength steel, in a standard annealing line, the atmosphere comprising from 3 to 20% of $H_2$ with a partial pressure of $H_2O$ corresponding to dew points between −40 and +10° C. has an oxidizing potential for alloying elements having higher affinity towards oxygen (compared to iron) such as Manganese (Mn), Aluminum (Al), Silicon (Si) or Chromium (Cr). Thus, even though the standard atmosphere is reducing for iron oxides, the mentioned alloying elements can oxidize and lead to the formation of layer of oxides at the surface. These oxides being for example manganese oxide (MnO) or silicon oxide ($SiO_2$) can be present in a form of a continuous film on the surface of the steel sheet or in the form of discontinuous nodules or small patches. They prevent the proper adherence of the metallic coating to be applied and can result in zones in which there is no coating on the final product or problems related to the delamination of the coating. To limit the existence of these alloying elements oxides layers a very low amount of $H_2O$ might allow decreasing the thickness and coverage of the steel surface by this oxide layer.

One approach is to lower the partial pressure of $H_2O$ in the annealing atmosphere by limiting reactions (1), (2) and (3) during the heating step. This is done by providing a very low amount of $H_2$, much lower than in a standard atmosphere as described above.

The patent application CN103507324 discloses an alloyed zinc aluminum magnesium alloy coated steel plate. According to the production method, cold rolled strip steel is subjected to continuous annealing and hot dipping in a continuous hot dip galvanizing unit, and then alloy treatment is carried out on the hot-dip galvanized zinc aluminum magnesium steel plate. Before the hot-dip galvanization, the steel sheet is annealed in an atmosphere comprising $N_2$ and 0.5-30 vol. % of $H_2$.

However, this patent application does not specify the method to implement in order to obtain a continuous annealing with an atmosphere comprising a very low amount of $H_2$. In examples, the amount of $H_2$ is of minimum 5 vol. %. Indeed, in practice, obtaining a very low amount of $H_2$ in a continuous annealing furnace is very difficult to get on an industrial scale.

SUMMARY OF THE INVENTION

An object of the invention is to provide an easy way to implement method for the manufacture of coated steel, the continuous annealing being performed in an atmosphere comprising a very low amount of $H_2$. The present invention provides a simple and low cost method on an industrial scale that makes it possible to improve the adherence of the subsequent coating on the steel sheet.

The present invention provides a method for the manufacture of a coated steel sheet comprising the successive following steps:

A. A continuous annealing of a steel sheet in a continuous annealing furnace comprising the following steps:

1) A pre-heating step performed at a pressure P1 in a pre-heating section comprising an atmosphere A1 made of at least one inert gas and containing 3.0 vol. % of $H_2$ or less, the dew point DP1 of A1 being below −20° C., such section comprising at least one opening O1 to allow entry of the steel sheet, 2) A heating step performed in a heating section at a pressure P2, higher than P1, comprising an atmosphere A2 made of at least one inert gas and containing 0.5 vol. % of $H_2$ or less, the dew point DP2 of A2 being below −40° C., incoming gas including the at least inert gas being continuously injected in the heating section, 3) A soaking step performed in a soaking section at a pressure P3, lower than P2, comprising an atmosphere A3 made of at least one inert gas and containing 3.0 vol. % of $H_2$ or less, the dew point DP3 of A3 being below −40° C., such section comprising at least one opening O3, 4) A cooling step performed at a pressure P4, higher than atmospheric pressure, in a cooling section comprising an atmosphere A4 made of at least one inert gas and including at least 1.0 vol. % of $H_2$, the dew point DP4 of A4 being below −30° C., 5) Optionally, an equalizing step performed in an equalizing section at a pressure P5 comprising an atmosphere A5 made of at least one inert gas and including at least 2.0 vol. % of $H_2$, the dew point DP5 of A5 being below −30° C., such section comprising at least one opening O5 and 6) A transfer step performed in a hot bridle section to guide the steel sheet towards the hot-dip coating step at a pressure P6 comprising an atmosphere A6 made of at least one inert gas and including at least 2.0 vol. % of $H_2$, the dew point DP6 of A6 being below −30° C., such section comprising optionally at least one opening O6, wherein A2 is continuously removed towards the pre-heating and soaking sections, A1 and A3 being discharged regularly or continuously outside the furnace through respectively O1 and O3 and wherein A6, or A5 and A6 are regularly or continuously discharged outside the furnace through respectively O6 or O5 and B. A hot-dip coating step.

Other characteristics and advantages of the invention will become apparent from the following detailed description of the invention.

BRIEF DESCRIPTION OF THE FIGURE

To illustrate the invention, various embodiments and trials of non-limiting examples will be described, particularly with reference to the following FIGURE:

FIG. 1 illustrates one example of the method for producing a coated steel sheet according to the present invention.

DETAILED DESCRIPTION

The following terms will be defined:

All percentages "%" of gas flows are defined by volume and

All percentages "%" of steel compositions are defined by weight.

The designation "steel" or "steel sheet" means a steel sheet having a composition allowing the part to achieve a tensile strength up to 2500 MPa and more preferably up to 2000 MPa. For example, the tensile strength is above or equal to 500 MPa, preferably above or equal to 1000 MPa, advantageously above or equal to 1500 MPa.

Preferably, the weight composition of steel sheet is as follows:

$0.05 \leq C \leq 0.6\%$,
$Mn \leq 6.0\%$,
$Si \leq 3.0\%$,
$0.02 \leq Cr \leq 2.0\%$,
$0.01 \leq Al \leq 4.0\%$,
$Nb \leq 0.2\%$,
$Ti \leq 0.4\%$,
$Mo \leq 1.0\%$,
$Ni \leq 3.0\%$,
$0.00001 \leq B \leq 0.1\%$, the balance being iron and unavoidable impurities from the manufacture of steel.

For example, the steel sheet can be an IF steel, a TRIP steel, a DP steel or a HSLA steel.

Steel sheet can be obtained by hot rolling and optionally cold rolling depending on the desired thickness, which can be for example between 0.7 and 3.0 mm.

The invention provides a method for the manufacture of a coated steel sheet comprising the successive following steps:

A. A continuous annealing of a steel sheet in a continuous annealing furnace comprising the following steps:

1) A pre-heating step performed at a pressure P1 in a pre-heating section comprising an atmosphere A1 made of at least one inert gas and containing 3.0 vol. % of $H_2$ or less, the dew point DP1 of A1 being below −20° C., such section comprising at least one opening O1 to allow entry of the steel sheet, 2) A heating step performed in a heating section at a pressure P2, higher than P1, comprising an atmosphere A2 made of at least one inert gas and containing 0.5 vol. % of $H_2$ or less, the dew point DP2 of A2 being below −40° C., incoming gas including the at least inert gas being continuously injected in the heating section, 3) A soaking step performed in a soaking section at a pressure P3, lower than P2, comprising an atmosphere A3 made of at least one inert gas and containing 3.0 vol. % of $H_2$ or less, the dew point DP3 of A3 being below −40° C., such section comprising at least one opening O3, 4) A cooling step performed at a pressure P4, higher than atmospheric pressure, in a cooling section comprising an atmosphere A4 made of at least one inert gas and including at least 1.0 vol. % of $H_2$, the dew point DP4 of A4 being below −30° C., 5) Optionally, an equalizing step performed in an equalizing section at a pressure P5 comprising an atmosphere A5 made of at least one inert gas and including at least 2.0 vol. % of $H_2$, the dew point DP5 of A5 being below −30° C., such section comprising at least one opening O5 and 6) A transfer step performed in a hot bridle section to guide the steel sheet towards the hot-dip coating step at a pressure P6 comprising an atmosphere A6 made of at least one inert gas and including at least 2.0 vol. % of $H_2$, the dew point DP6 of A6 being below −30° C., such section comprising optionally at least one opening O6, wherein A2 is continuously removed towards the pre-heating and soaking sections, A1 and A3 being discharged regularly or continuously outside the furnace through respectively O1 and O3 and wherein A6, or A5 and A6 are regularly or continuously discharged outside the furnace through respectively O6 or O5 and B. A hot-dip coating step.

Thus, the method comprises firstly the pre-heating step 1) usually realized during a pre-heating time t1 between 1 and 90 s. Preferably, the pre-heating section comprises between 1 to 5 openings O1, more preferably 1 or 2 openings O1. Preferably, the dew point DP1 is below than −30° C., more preferably below than −40° C. and advantageously below than −50° C.

Then, the heating step 2) is performed for example during a heating time t2 between 30 and 810 s. In this step, it is believed that iron oxides present on steel sheet are reduced into metallic iron ($Fe^{(0)}$) by the carbon present in the steel sheet by one or several of the following reactions:

$$FeO+C \rightarrow CO+Fe^{(0)}, \quad (1)$$

$$Fe_2O_3+3C \rightarrow 3CO+2Fe^{(0)} \text{ and} \quad (2)$$

$$Fe_3O_4+4C \rightarrow 4CO+3Fe^{(0)}. \quad (3)$$

Indeed, without willing to be bound by any theory, it seems that the absence or the residual presence, i.e. below or equal to 0.5% by volume in the heating section, of $H_2$ prevents or at least significantly limits the formation of $H_2O$. Thus, especially for high strength steel or ultra-high strength steel having alloying elements with a high affinity with oxygen, the formation of their oxides is drastically limited during the annealing. It results in a really good surface preparation of the steel sheet for the hot-dip coating, i.e. a good coatability and wettability of the steel sheet surface.

Preferably, the pre-heating step 1) is performed by heating the steel sheet at ambient temperature to temperature T1, T1 being between 200 and 350° C., and the heating step 2) is performed by heating the steel sheet from T1 to T2, T2 being between 600-1000° C. Without willing to be bound by any theory, it is believed that reactions (1), (2) and (3) are performed between 350 and 1000° C.

After the heating step 2), a soaking step is performed, usually during a soaking time t3 between 30 and 480 s.

To obtain a continuous annealing having an atmosphere comprising a very low amount of $H_2$ for preventing the formation of $H_2O$, in addition not to inject $H_2$ and $H_2O$ into the heating area, the inventors have discovered that it is important to manage differently the gas flows in industrial furnaces. Indeed, usually, gases flow from the soaking area towards the heating area before getting out of the furnace in the pre-heating area. In such case, it is not possible to obtain the desired atmosphere especially in the heating section where a very low amount of $H_2$ is needed.

It has surprisingly been found that a zoning is realized between the cooling and the soaking areas by the presence of at least one opening O3 in the soaking area. Thus, A2 is continuously removed towards the pre-heating and soaking sections, A1 and A3 are discharged regularly or continuously outside the furnace through respectively O1 and O3. So, the presence of $H_2$ until 3.0% in the soaking area is acceptable since $H_2$ does not rise in the heating zone and no $H_2O$ can be formed in the soaking area with regard to the reactions (1), (2) and/or (3) since iron oxides on the steel surface have been already reduced to metallic iron in the heating section. According to the invention, only residual gas flow can come from the soaking area or the pre-heating in the heating area resulting in a desired zoning of the heating area. In the soaking area, the presence of $H_2$ until 3.0% can be due to a leak coming from the cooling section. In the pre-heating area, the presence of $H_2$ until 3.0% can be due to a leak coming from O1.

Preferably, the soaking section comprises between 1 to 5 openings O3, more preferably 1 or 2 openings O3.

Preferably, the percentage of outgoing gas flow removed through O1 with respect to the incoming gas of the continuous furnace are above or equal to 15% and the percentage of outgoing gas flow through O3 with respect to the incoming gas of the continuous furnace is above or equal to 25%. Advantageously, the percentage of outgoing gas flow through O3 with respect to the incoming gas of the continuous furnace is above or equal to 30%. Preferably, the incoming gas comes from the heating section and travelled through the soaking section.

In a preferred embodiment, independently to each another, the atmospheres A1 and A3 comprise $H_2$ in the amount below or equal to 1.0%, preferably below or equal 0.5% by volume.

Advantageously, at least one of the atmospheres chosen from A1, A2 and A3 comprises $H_2$ in the amount below or equal to 0.25% by volume.

Preferably, at least one of the dew point chosen from DP2 and DP3 is below −50° C. Preferably, the soaking step 3) is realized by heating the steel sheet from the temperature T2 to a soaking temperature T3, T3 being between 600 and 1000° C. In this preferred embodiment, T2 is preferably equal to T3. In some cases, T2 can be lower or higher than T3 so the temperature of the steel sheet is regulated depending on both temperatures.

Then, the steel sheet is preferably cooled from T3 to a temperature T4 between 400 and 800° C. This temperature is the steel strip entry temperature into the bath. Usually, the cooling step is performed during a cooling time t4 between 1 and 50 s. Preferably, the cooling step 4) is performed in an atmosphere A4 including at least 10% of $H_2$.

In one preferred embodiment, P4 is higher than P3, A4 being continuously removed towards the opening O3 of the soaking section. In another preferred embodiment, P4 is lower than P3, A4 being continuously removed towards the hot bridle or equalizing section. Thus, depending on the difference of pressure between P4 and P3, the gas flow in the furnace changes so that A4 is removed towards O3 or towards the hot bridle or equalizing section.

Then, preferably, an equalizing step 5) is performed in an equalizing section to equalize the temperature of the edges and the center of the steel sheet and optionally to realize an overaging.

After, a transfer step 6) is performed in a hot bridle section to guide the steel sheet towards the hot-dip coating.

According to the invention, A6 is regularly or continuously discharged outside the furnace through respectively O6, or A5 and A6 are regularly or continuously discharged outside the furnace through respectively O5. Preferably, in the hot bridle section or in the equalizing area, the percentage of outgoing gas flow removed through O5 or O6 with respect to the incoming gas of the continuous furnace is above or equal to 15%. Preferably, the equalizing or the hot bridle section comprises between 1 to 5 openings O5 or O6, more preferably 1 or 2 openings O5 or O6.

Preferably, at least one of the dew point chosen from DP4, DP5 and DP6 is below −40° C.

Advantageously, the equalizing step 5) and the transfer step 6) are performed at temperature T5 between 400 and 800° C. during a time t5 usually between 20 and 1000 s.

Preferably, the inert gas is also continuously injected in the pre-heating area, the soaking section or both.

Preferably, the inert gas and $H_2$ are continuously injected in at least one of the section chosen from the cooling section, the equalizing section and the hot bridle section. In this preferred embodiment, the incoming gas further includes the injected inert gas and the injected $H_2$.

The inert gas and $H_2$ can be injected in the furnace by any device known for the skilled in the art The inert gas is for example chosen among nitrogen, helium, neon, argon, krypton, xenon or a mixture thereof.

Preferably, the opening is a hole controlled by a valve, an exhaust pipe controlled by a valve or an entry seal for the strip.

Then, the coating deposition B) is performed by a hot-dip coating. Preferably, the step B) is performed with a metallic molten bath comprising at least one of the following elements chosen from zinc, aluminum, silicon and magnesium and unavoidable impurities and residuals elements from feeding ingots or from the passage of the steel sheet in the molten bath.

For example, the optional impurities are chosen from Sr, Sb, Pb, Ti, Ca, Mn, Sn, La, Ce, Cr, Zr or Bi, the content by weight of each additional element being inferior to 0.3% by weight. The residual elements from feeding ingots or from the passage of the steel sheet in the molten bath can be iron with a content up to 5.0%, preferably 3.0%, by weight.

The composition of the molten bath depends on the desired coatings. For example, they can be as follows (all contents are in % by weight):

- Zinc coatings: up to 0.3% of Al, iron-saturated, the remainder being Zn,
- Zinc-based coatings: 0.1-8.0% Al, 0.2-8.0% Mg, iron-saturated, the remainder being Zn or
- Aluminum-based coating comprising less than 15% Si, less than 5.0% Fe, optionally Mg and Zn, the remainder being Al.

Then, the steel sheet can be heated to form an alloy. For example, a galvannealed steel sheet can be obtained after such heat treatment.

The invention will now be explained in trials carried out for information only. They are not limiting.

EXAMPLES

Example 1: Continuous Annealing

This test, illustrated in FIG. 1, is used to determine the efficiency of the method according to the present invention. G means the gas flow present in the annealing furnace.

In this Example, the steel sheet HSLA320 having the following weight composition was used:

| Trial | C % | Mn % | Si % | S % | P % | Cr % | % Mo | % Al | % Nb | % Ti | % N | % B |
|---|---|---|---|---|---|---|---|---|---|---|---|---|
| 1 | 0.061 | 0.353 | 0.012 | 0.0064 | 0.150 | 0.015 | 0.001 | 0.033 | 0.031 | 0.001 | 0.004 | 0.0002 |

Additionally, in this Example, all pressures are defined as relative values with respect to the atmospheric pressure. It means that we have to add the atmospheric pressure, i.e. 1013.25 mbar, to all the relative pressures to obtain the real pressures.

Firstly, in the pre-heating section 1, trial 1 was heated from ambient temperature to T1 of 330° C. during 34 s in an atmosphere A1 made of $N_2$ with DP1 of −41° C., $N_2$ being continuously injected in the pre-heating section via the injection openings 7, such section comprising one opening O1 being an entry seal. P1 was of 0.50 mbar at relative pressure, i.e. 1013.75 mbar, and the measured amount of H2 was of 0.08 vol. %.

Then, in the heating section 2, trial 1 was heated from 330 to T2 of 824° C. during 314 s in an atmosphere A2 made of $N_2$ with DP2 of −52° C., $N_2$ being continuously injected in the heating section via the injection openings 8. P2 was of 0.64 mbar at relative pressure, i.e. 1013.84 mbar, and the measured amount of H2 was of 0.08 vol. %.

A soaking step is then realized at T3 of 775° C. during 119 s in an atmosphere A3 made of $N_2$ with DP3 of −52° C., $N_2$ being continuously injected in the soaking section 3 via the injection openings 9, such section comprising one opening O3 thanks to an opened valve. P3 was of 0.56 mbar at relative pressure, i.e. 1013.81 mbar, and the measured amount of H2 was of 0.4%.

The trial was cooled from 775° C. to T4 of 456° C. during 17 s in a cooling section 4 comprising an atmosphere A4 made of $N_2$ and 11.5 vol % of $H_2$ with a DP4 of −50° C. P4 was of 1.71 mbar at relative pressure, i.e. 1014.96 mbar.

After, an equalizing step was performed at T5 of 456° C. during 59 s comprising an atmosphere A5 made of $N_2$ and $H_2$, $N_2$ and 6.5 vol % of $H_2$ being continuously injected with DP5 of −50° C., such section 5 comprising one opening O5 thanks to an opened valve. P5 was of 1.98 mbar at relative pressure, i.e. 1015.23 mbar.

The trial was guided towards the hot-dip coating in a hot bridle section 6 comprising an atmosphere A6 made of $N_2$ and $H_2$, $N_2$ and 6.5 vol. % of $H_2$ being continuously injected with DP6 of −52° C. P6 was of 1.98 mbar at relative pressure, i.e. 1015.23 mbar.

Finally, the trial was coated by hot-dip coating in a molten bath comprising 0.13% of Al, iron-saturated, the balance being zinc. The coated steel sheet was then annealed. Thus, A2 was continuously removed towards the pre-heating and soaking sections, A1 and A3 were discharged continuously outside the furnace through respectively O1 and O3. The percentage of outgoing gas flow G1 removed through O1 with respect to the incoming gas of the continuous furnace was equal to 28%. The percentage of outgoing gas flow G3 through O3 with respect to the incoming gas of the continuous furnace was equal to 39%.

A4 was continuously discharged outside the furnace through O3 and 04.

A5 and A6 were continuously discharged outside the furnace through O5. The percentage of outgoing gas flow G5 removed through O5 with respect to the incoming gas of the continuous furnace was of 24%.

It is believed that the rest of the injected gas, here 9%, was removed through some leaks.

The method according to the present invention allows a heating performed in an atmosphere comprising a very low amount of $H_2$ thanks to the management of gas flow in the continuous annealing.

Additionally, the coatability was tested by naked eyes after the hot-dip coating. The coverage of zinc coating was good, i.e. the zinc coating was homogeneously distributed on the steel sheet, and no surface defect appeared. Finally, a coated steel sample from the trial was bent at an angle of 180°. An adhesive tape was then applied on the sample before being removed to determine if the coating was taken off. The zinc coating has not been taken off which means that the zinc coating adhered well to the steel sheet.

What is claimed is:

1. A method for the manufacture of a coated steel sheet comprising the following steps:

continuously annealing a steel sheet in a continuous annealing furnace;

and hot-dip coating the steel sheet;

the annealing step comprising the following steps:

pre-heating the steel sheet at a pressure P1 in a pre-heating section comprising an atmosphere A1 made of at least one inert gas and containing 3.0 vol. % of $H_2$ or less, the dew point DP1 of A1 being below −20° C., the pre-heating section comprising at least one opening 01 to allow entry of the steel sheet;

heating the steel sheet in a heating section at a pressure P2, higher than P1, comprising an atmosphere A2 made of at least one inert gas and containing 0.5 vol. % of $H_2$ or less, the dew point DP2 of A2 being below −40° C., incoming gas including the at least one inert gas being continuously injected in the heating section;

soaking the steel sheet in a soaking section at a pressure P3, lower than P2, comprising an atmosphere A3 made of at least one inert gas and containing 3.0 vol. % of $H_2$ or less, the dew point DP3 of A3 being below −40° C., the soaking section comprising at least one opening 03;

cooling the steel sheet at a pressure P4, higher than atmospheric pressure, in a cooling section comprising an atmosphere A4 made of at least one inert gas and including at least 1.0 vol. % of $H_2$, the dew point DP4 of A4 being below −30° C.;

optionally, equalizing the steel sheet in an equalizing section at a pressure P5 comprising an atmosphere A5 made of at least one inert gas and including at least 2.0 vol. % of $H_2$, the dew point DP5 of A5 being below −30° C., the equalizing section comprising at least one opening 05; and transferring the steel sheet in a hot bridle section to guide the steel sheet towards a hot-dip coating section at a pressure P6 comprising an atmosphere A6 made of at least one inert gas and including at least 2.0 vol. % of $H_2$, the dew point DP6 of A6 being below −30° C., the hot bridle section comprising optionally at least one opening 06, wherein A2 is continuously removed towards the pre-heating and soaking sections, A1 and A3 being discharged regularly or continuously outside the furnace through respectively 01 and 03 and wherein, if the method comprises the equalizing of the steel sheet and the at least one opening 05 or the hot bridle section comprises the at least one opening 06, A6, or A5 and A6 are regularly or continuously discharged outside the furnace through respectively 06 or 05.

2. The method according to claim 1, wherein a percentage of outgoing gas flow removed through 01 with respect to incoming gas of the continuous furnace is greater than or equal to 15 vol. % and a percentage of outgoing gas flow through 03 with respect to incoming gas of the continuous furnace is greater than or equal to 25 vol. %.

3. The method according to claim 1, wherein a percentage of outgoing gas flow through 03 with respect to incoming gas of the continuous furnace is greater than or equal to 30 vol. %.

4. The method according to claim 1, wherein the atmospheres A1 and A3 comprise 1.0% or less $H_2$ by volume.

5. The method according to claim 4, wherein the atmospheres A1 and A3 comprise 0.5% or less $H_2$ by volume.

6. The method according to claim 1, wherein at least one of the atmospheres A1, A2 and A3 comprises 0.25% or less $H_2$ by volume.

7. The method according to claim 1, wherein the dew point DP1 is below −30° C.

8. The method according to claim 7, where the dew point DP 1 is below −40° C.

9. The method according to claim 1, wherein at least one of the dew points DP1, DP2 and DP3 is below −50° C.

10. The method according to claim 1, wherein at least one of the dew points DP4, DP5 and DP6 is below −40° C.

11. The method according to claim 1, wherein the pre-heating step includes heating the steel sheet at an ambient temperature to temperature T1, T1 being between 200 and 350° C., and the heating step includes heating the steel sheet from T1 to temperature T2, T2 being from 600 to 1000° C.

12. The method according to claim 1, further comprising heating the steel sheet from a temperature T2 to a soaking temperature T3, T3 being between 600 and 1000° C.

13. The method according to claim 1, wherein P4 is higher than P3 and A4 is continuously removed towards the opening 03 of the soaking section.

14. The method according to claim 1, wherein P4 is lower than P3 and A4 is continuously removed towards the hot bridle or equalizing section.

15. The method according to claim 1, wherein the cooling step is performed in an atmosphere A4 including at least 10 vol. % of $H_2$.

16. The method according to claim 1, wherein the steel sheet is cooled from T3 to a temperature T4 between 400 and 800° C.

17. The method according to claim 1, wherein the equalizing step and the transfer step are performed at a temperature T5 between 400 and 800° C.

18. The method according to claim 1, wherein in the hot bridle section or in the equalizing section, a percentage of outgoing gas flow removed through 05 or 06 with respect to incoming gas of the continuous furnace is greater than or equal to 15 vol. %.

19. The method according to claim 1, wherein the at least one inert gas is continuously injected in the pre-heating section, the soaking section or both sections.

20. The method according to claim 1, wherein the at least one inert gas and $H_2$ are continuously injected in at least one of the cooling section, the equalizing section and the hot bridle section, the incoming gas further including the injected inert gas and the injected $H_2$.

21. The method according to claim 1, wherein the at least one inert gas is chosen from nitrogen, helium, neon, argon, krypton, xenon or a mixture thereof.

22. The method according to claim 1, wherein the opening is a hole controlled by a valve, an exhaust pipe controlled by a valve or an entry seal for the steel sheet.

23. The method according to claim 1, wherein the hot dip coating step includes a metallic molten bath comprising at least one of the following elements chosen from zinc, aluminum, silicon and magnesium and unavoidable impurities and residual elements from feeding ingots or from the passage of the steel sheet in the molten bath.

24. The method according to claim 23, further comprising the step of annealing the metallic coated steel sheet after the step of hot-dip coating.

25. The method according to claim 1, wherein the steps are performed successively.

26. The method according to claim 1, wherein the method comprises the step of the equalizing the steel sheet.

27. The method according to claim 1, wherein the hot bridle section comprises the at least one opening 06.

* * * * *